US008728253B2

(12) United States Patent
Faβbender et al.

(10) Patent No.: US 8,728,253 B2
(45) Date of Patent: May 20, 2014

(54) METHOD FOR HANDLING AQUEOUS METHANESULFONIC ACID SOLUTIONS

(75) Inventors: Stefan Faβbender, Speyer (DE); Peter Petersen, Dannstadt-Schauernheim (DE); Arnulf Lauterbach, Ludwigshafen (DE); Günter Renz, Freinsheim (DE); Frieder Borgmeier, Mannheim (DE); Peter Kolb, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 361 days.

(21) Appl. No.: 12/917,796

(22) Filed: Nov. 2, 2010

(65) Prior Publication Data

US 2011/0108120 A1 May 12, 2011

(30) Foreign Application Priority Data

Nov. 3, 2009 (EP) ..... 09174853

(51) Int. Cl.
*C22C 38/40* (2006.01)
*C22C 38/44* (2006.01)
*C22C 38/50* (2006.01)

(52) U.S. Cl.
USPC ..... 148/327; 420/43

(58) Field of Classification Search
USPC ..... 148/327; 420/53, 43, 52, 54
See application file for complete search history.

(56) References Cited

U.S. PATENT DOCUMENTS 3,626,004 A 12/1971 Guertin
3,960,671 A * 6/1976 Clovis et al. ..... 203/7
6,060,621 A 5/2000 Biertuempel et al.
6,120,619 A 9/2000 Goudiakas et al.
6,531,629 B1 3/2003 Eiermann et al.
2008/0031848 A1 2/2008 Konradi et al.

FOREIGN PATENT DOCUMENTS

EP 906904 A2 4/1999
EP 0971045 A1 * 1/2000
EP 1361290 A1 * 11/2003
JP 58-184094 * 10/1983
JP H04120250 A 4/1992
JP H07278854 A 10/1995
WO WO-00/31027 A1 6/2000
WO WO-2006/092439 A1 9/2006

OTHER PUBLICATIONS

Lutropur MSA brochure, "The 'green' acid for use in cleaners," Oct. 2005 Edition, BASF SE, Ludwigshafen, Germany.

Arkema, Inc., "Arkema Methanesulfonic Acid—Cleaning and Descaling" Jan. 17, 2007, pp. 1-4.

Gaur, B. et al., "Corrosion of metals and alloys in methane sulphonic acid" British Corrosion Journal, 1999, vol. 34, No. 1, pp. 63-66, IOM Communications, Stoke-on-Trent, UK.

* cited by examiner

*Primary Examiner* — Deborah Yee
(74) *Attorney, Agent, or Firm* — Novak Druce Connolly Bove + Quigg LLP

(57) ABSTRACT

A method for handling aqueous solutions of methanesulfonic acid (MSA) having a concentration from 50 to 99% by weight of MSA and a total chlorine content of less than 50 mg/kg in apparatuses in which the aqueous MSA solution is in contact with steel surfaces. The steel comprises austenitic steels having a chromium content of from 15 to 22% by weight and a nickel content of from 9 to 15% by weight.

6 Claims, 1 Drawing Sheet

METHOD FOR HANDLING AQUEOUS METHANESULFONIC ACID SOLUTIONS

CROSS-REFERENCE TO RELATED APPLICATIONS

This application claims benefit of European patent application 09174853.3 filed Nov. 3, 2009, the contents of which are incorporated herein by reference in its entirety.

FIELD OF THE INVENTION

The present invention relates to a method for handling aqueous solutions of methanesulfonic acid in apparatuses comprising austenitic steels having a chromium content of from 15 to 22% by weight and a nickel content of from 9 to 15% by weight.

BACKGROUND OF THE INVENTION

Methanesulfonic acid ($H_3CSO_3H$, MSA) is a strong organic acid which is used for a multiplicity of different processes, for example for electroplating processes, in chemical synthesis, in cleaning agents or for tertiary mineral oil production.

MSA can be prepared by various processes, for example by oxidation of methanethiol by means of $Cl_2$, followed by hydrolysis, as disclosed, for example, in U.S. Pat. No. 3,626,004. Alternatively, it is also possible to oxidize dimethyl disulfide with $Cl_2$. The processes lead to MSA which, in spite of purification, still comprises significant amounts of chlorine compounds, for example chloride.

WO 00/31027 discloses a process for oxidizing dimethyl disulfide with nitric acid to MSA, the oxides of nitrogen which are formed being reacted with $O_2$ to give nitric acid again and this being recycled to the process. CN1 810 780 A discloses a process in which ammonium sulfite and/or ammonium hydrogen sulfite is reacted with dimethyl sulfate to give ammonium methanesulfonate and ammonium sulfate. The ammonium sulfate can be precipitated with $Ca^{2+}$ as $CaSO_4$. MSA can be liberated from the remaining $Ca(CH_3SO_3)_2$ with sulfuric acid and can be worked up, once again $CaSO_4$ being precipitated. EP 906 904 A2 discloses a process in which sodium sulfite is reacted with dimethyl sulfate. MSA can be liberated from the resulting mixture after acidification with concentrated sulfuric acid. The three last mentioned processes have the advantage that the MSA obtained is virtually free of chlorine compounds.

As an acid, MSA can of course attack metals. Low-alloy steels are usually not stable to MSA. WO 2006/092439 A1 investigates the corrosion behavior of low-alloy steel for pressure containers (material number 1.0425, about 0.3% of Cr, about 0.3% of Ni, from 0.8 to 1.4% of Mn) in 70% strength MSA. The steel is attacked by MSA to a substantially lesser extent than by hydrochloric acid but the addition of corrosion inhibitors is necessary in order to reduce the removal of metal to an acceptable level.

In relevant brochures, polyethylene, polypropylene, polyester, polystyrene, glass enamel, ceramics, tantalum or zirconium are proposed as materials for handling methanesulfonic acid. Furthermore, the use of steel having a material number 1.4539 and 1.4591 was also proposed (Lutropur® MSA brochure, *"Die "grüne" Säure für Reiniger"*, 10/2005 edition, BASF SE, Ludwigshafen). Such steels are high-alloy chromium nickel steel (1.4539 about 20% of Cr, about 25% of Ni, 1.4591 about 33% of Cr, about 31% of Ni).

As a material for apparatuses for handling MSA, for example for storage and/or transport, the use of steel having sufficient resistance to MSA is highly desirable because only in this way is it possible to avoid providing containers, apparatuses and pipelines with internal linings comprising corrosion-resistant materials. The abovementioned steels are very expensive special steels which are difficult to procure. Workpieces comprising these steels are accordingly expensive and the use of such steels for relatively large components, such as, for example, tanks, is therefore uneconomical.

BRIEF SUMMARY OF THE INVENTION

It was therefore an object of the invention to provide cheaper, lower-alloy steels for the production of such components, which steels nevertheless have good corrosion resistance to aqueous MSA solutions.

Accordingly, a method for handling aqueous solutions of methanesulfonic acid (MSA) having a concentration of from 50 to 99% by weight of MSA and a total chlorine content of less than 50 mg/kg in apparatuses in which the aqueous MSA solution is in contact with steel surfaces was found, the steel comprising austenitic steels having a chromium content of from 15 to 22% by weight and a nickel content of from 9 to 15% by weight.

DETAILED DESCRIPTION OF THE PREFERRED EMBODIMENTS

Figure 1:
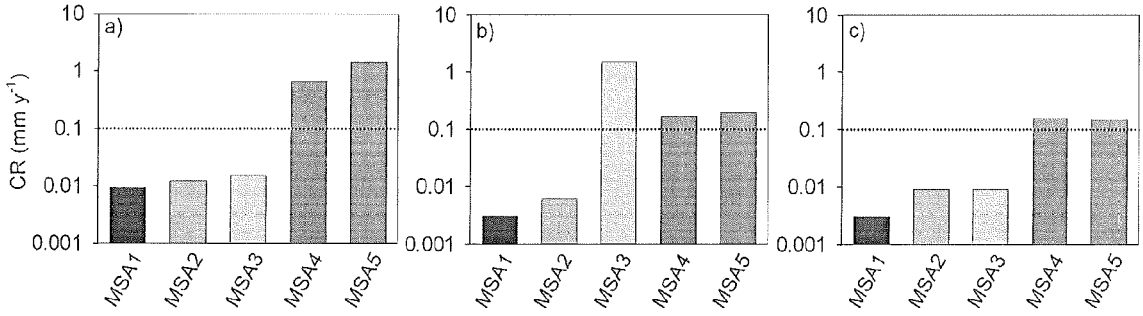
FIG. 1 shows the corrosion rates (CR) in mm/year for steels No. 1 (FIG. 1*a*), 2 (FIG. 1*b*) and 3 (FIG. 1*c*).

Regarding the invention, the following may be stated specifically:

The method according to the invention relates to the handling of aqueous solutions of methanesulfonic acid ($H_3CSO_3H$, MSA) in apparatuses in which the aqueous MSA solution is in contact with steel surfaces.

Here, the aqueous MSA solutions have a concentration of from 50 to 99% by weight of MSA, based on the sum of all constituents of the aqueous solution. Preferably, the concentration is from 55 to 90% by weight, particularly preferably from 60 to 80% by weight and very particularly preferably about 70% by weight.

The aqueous MSA solutions can moreover also comprise customary secondary constituents and/or impurities in addition to water and MSA.

According to the invention, the total chlorine content in the aqueous MSA solution is less than 50 mg/kg, preferably less than 25 mg/kg and very particularly preferably less than 10 mg/kg. The chlorine may be, for example, chlorine in the form of chloride ions or chlorine bound in organic compounds.

MSA solutions having such a low total chlorine content can be prepared by processes known to the person skilled in the art, for example by oxidation of dimethyl disulfide by means of nitric acid by means of the process disclosed in WO 00/31027 or from ammonium sulfite and/or ammonium hydrogen sulfite by reaction with dimethyl sulfate.

The aqueous MSA solution can moreover comprise sulfate ions as an impurity. However, the amount of sulfate ions should as a rule be less than 300 mg/kg, preferably less than 200 mg/kg, particularly preferably less than 100 mg/kg and particularly less than 30 mg/kg.

The term "handling" is intended to comprise all methods of handling aqueous MSA solutions in apparatuses, in particular during the entire product flow from production to use. It may comprise in particular the storage, the transport or the use of MSA solutions. Preferably, it comprises the storage and/or the transport of aqueous MSA solutions.

The apparatuses may be all types of apparatuses which are used in the course of handling aqueous MSA solutions, provided that they have steel surfaces with which the aqueous MSA solutions can come into contact. The apparatuses may consist here in their entirety of such steels but they can of course also comprise other materials. For example, the apparatuses may be those comprising another material or another steel which are lined with the steel according to the invention.

The apparatuses may be closed or open apparatuses, for example apparatuses selected from the group consisting of tanks, storage containers, tanks of railway tank cars, tanks of tanker trucks, tank containers, reaction tanks, metering apparatuses, pipelines, flanges, pumps or instrumentation components, troughs, drums, apparatuses for electroplating, internals of tanks, such as baffles, stirrers or metering pipes.

According to the invention, the steel surfaces which are in contact with the aqueous MSA solution are surfaces of austenitic steels having a chromium content of from 15 to 22% by weight and a nickel content of from 9 to 15% by weight.

The term "austenitic steel" is known to the person skilled in the art, for example from "*Römpp Online, Version* 3.5, *Georg Thieme Verlag* 2009".

The preferred chromium content is from 16 to 20% by weight and the preferred Ni content is from 10 to 14% by weight.

As a rule, the steel moreover comprises manganese, in particular in an amount of from 1 to 3% by weight.

In addition, the steels used according to the invention may comprise from 1 to 5% by weight of molybdenum, preferably from 1.5 to 4, particularly preferably from 2 to 3, % by weight.

Furthermore, the steels may comprise from 0.1 to 2% by weight of titanium, preferably from 0.5 to 1% by weight.

In particular, there may be steels which comprise the elements stated below (data in each case in % by weight):

| | | Mn | Cr | Ni | Mo | Ti |
|---|---|---|---|---|---|---|
| Preferred | steel 1 | about 2 | 18-20 | ca. 10.5 | — | — |
| | steel 2 | about 2 | 16-18 | 10.0-14.0 | 2-3 | — |
| Particularly preferred | steel 3 | ≤2 | 16.5-18.5 | 10.5-13.5 | 2.0-2.5 | ≤0.70 |

The temperature of the MSA which is in contact with the steel surface during handling is as a rule less than 40° C., without it being intended to limit the invention thereby to this temperature. Preferably, the temperature is from 10 to 40°, preferably from 15 to 30° C. and, for example, about ambient temperature.

The present examples are intended to further illustrate the invention:

Materials Used:

Solutions of in each case 70% by weight of MSA in water were used for the following experiments. The preparation processes for the MSA used in each case are listed in table 1 and the analytical data are listed in table 2.

TABLE 1

Preparation of the MSA used

| | Preparation process |
|---|---|
| MSA 1 | Oxidation of dimethyl disulfide according to WO 00/31027 |
| MSA 2 | Reaction of $(NH_4)_2SO_3/NH_4HSO_3$ with $(CH_3)_2SO_2$, precipitation of sulfate with $Ca(OH)_2$, followed by $H_2SO_4$ treatment |
| MSA 3 | Oxidation of dimethyl disulfide with $Cl_2$, followed by hydrolysis |
| MSA 4 | Oxidation of dimethyl disulfide with $Cl_2$, followed by hydrolysis (different manufacturer) |
| MSA 5 | Oxidation of $CH_3SH$ with $Cl_2$, followed by hydrolysis |

TABLE 2

Analytical data

| | MSA 1 | MSA 2 | Comparison MSA 3 | Comparison MSA 4 | Comparison MSA 5 |
|---|---|---|---|---|---|
| $SO_4^{2-}$ [mg/kg] | 8 | 155 | 31 | 55 | 56 |
| $Cl^-$ [mg/kg] | <5 | <5 | <5 | 7 | <5 |
| $NO_3^-$ [mg/kg] | <5 | 8 | <5 | 9 | <5 |
| $NO_2^-$ [mg/kg] | <5 | <5 | <5 | <5 | <5 |
| Total metal content [mg/kg] | <1 | <1 | 4.2 | <1 | <1 |
| Total content bound chlorine [mg/kg] | <1 | 7 | 350 | 170 | 83 |
| Oxidizable components [mg/kg] | <1 | <1 | <1 | <1 | <1 |

The steel grades stated in table 3 were used for the experiments. The steels No. 1, 2 and 3 are austenitic steels and No. C4 is a martensitic steel (comparative experiment).

TABLE 3

Steel grades used

| Steel No. | Material number | Density [g/cm³] | C | Mn | Si | P | Cr | Ni | N | Mo | Ti |
|---|---|---|---|---|---|---|---|---|---|---|---|
| 1 | 1.4301/304 | 7.92 | 0.08 | 2.0 | 0.75 | 0.045 | 18.0-20.0 | 10.5 | 0.1 | | — |
| 2 | 1.4401/316 | 7.98 | 0.08 | 2.0 | 0.75 | 0.045 | 16.0-18.0 | 10.0-14.0 | 0.1 | 2-3 | — |
| 3 | 1.4571/316Ti | 7.98 | ≤0.08 | ≤2.0 | ≤1.0 | ≤0.045 | 16.5-18.5 | 10.5-13.5 | — | 2.0-2.5 | ≤0.70 |
| C4 | 1.4006/420 | 7.7 | 0.15 | 1 | 1 | 0.04 | 12.0-14.0 | — | — | — | — |

Carrying Out the Experiments:

The tests were carried out in a 1 liter glass flask having a flat bottom with stirring in order to simulate the flow of MSA. Test sheets of the above-mentioned steel grades were used for fixing (20 mm×50 mm×1 mm) and were provided with a 5 mm hole, cleaned in an ultrasonic bath, dried by means of a nitrogen gas stream and weighed. The steel sheets were suspended in the flask by means of a Teflon holder and the flask was closed. The MSA in the flask was stirred by means of a magnetic stirrer at 750 rpm. After the end of the experiments, the steel sheets were removed from the sample vessel, washed with demineralized water, wiped carefully with an absorbent paper (for removing coarse corrosion products), washed again with demineralized water, dried and weighed. The duration of the experiment was 7 days in each case and the temperature was 23° C. In the case of steel No. 4, the duration of the experiment was 1 day.

In each case the corrosion rate in mm removal/year was calculated from the mass difference according to the following formula:

$$\text{Corrosion rate [mm/a]}=87\,600*\Delta_m/A*\rho*t,$$

in which $\Delta_m$ is the change in mass of the steel sheet [g], A is the area of the steel sheet [$cm^2$], ρ is the density of the steel [$g/cm^3$] and t is the duration of the experiment [h]. The factor 87 600 serves for converting from cm/h into mm/a.

Figure 2:
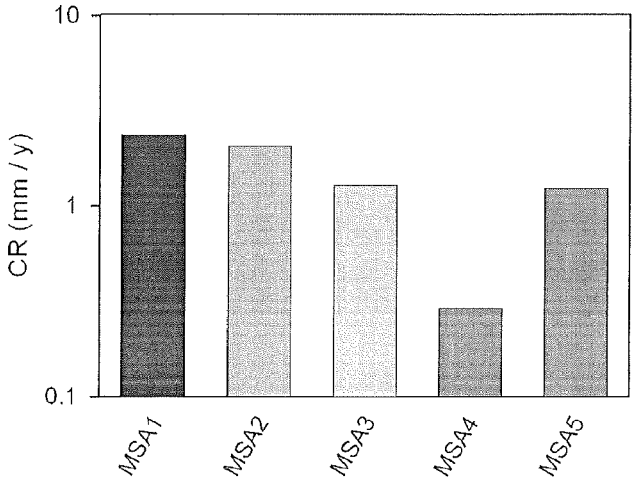
FIG. 2 shows corrosion rates (CR) in mm/year for the martensitic stell No. C4.

The results are listed in FIGS. 1 and 2.

FIG. 1 shows the corrosion rates (CR) in mm/year for steels No. 1 (FIG. 1*a*), 2 (FIG. 1*b*) and 3 (FIG. 1*c*). The experiments show that low corrosion rates are achieved in all experiments only with the methanesulfonic acids which have a low content of total chlorine. MSA3 gives reasonable results for steels No. 1 and No. 3, but not for steel No. 2. The corrosion rate is about 0.01 mm/a for MSA 1 and steel No. 1 and is substantially below 0.01 mm/a with the use of steels No. 2 and 3.

FIG. 2 shows corrosion rates (CR) in mm/year for the non-inventive martensitic steel No. C4. The comparative experiment shows that the corrosion rate in the case of all methanesulfonic acids is greater than 0.1 mm/a, interestingly, in the case of steel No. 4, MSA 3, MSA 4 and MSA 5 with higher chlorine content performing slightly better than the low-chlorine MSA 1 and MSA 2. Corrosion rates of more than 0.1.

The invention claimed is:

1. A method for handling aqueous solutions of methanesulfonic acid (MSA) having a concentration of from 50 to 99% by weight of MSA and a total chlorine content of less than 50 mg/kg in apparatuses in which the aqueous MSA solution is in contact with steel surfaces, wherein the steel comprises austenitic steels having a chromium content of from 15 to 22% by weight and a nickel content of from 9 to 15% by weight.

2. The method according to claim 1, wherein the steels furthermore comprise from 1 to 5% by weight of molybdenum.

3. The method according to claim 2, wherein the steels furthermore comprise from 0.1 to 2% by weight of titanium.

4. The method according to claim 1, wherein the temperature of the MSA in the course of the handling is less than 40° C.

5. The method according to claim 1, wherein the concentration of the MSA in the aqueous solution is from 60 to 80% by weight.

6. The method according to claim 1, wherein the apparatuses are apparatuses selected from the group consisting of tanks, storage containers, tanks of railway tank cars, tanks of tanker trucks, tank containers, reaction tanks, metering apparatuses, pipelines, flanges, pumps or instrumentation components.

* * * * *